US007850053B2

(12) United States Patent
Rassias

(10) Patent No.: US 7,850,053 B2
(45) Date of Patent: Dec. 14, 2010

(54) SECURITY HOLSTER WITH LOCKING LEVER

(76) Inventor: John N. Rassias, 7678 Cedarwood Cir., Boca Raton, FL (US) 33434

( * ) Notice: Subject to any disclaimer, the term of this patent is extended or adjusted under 35 U.S.C. 154(b) by 1070 days.

(21) Appl. No.: 11/596,093

(22) PCT Filed: Sep. 9, 2004

(86) PCT No.: PCT/US2004/029556

§ 371 (c)(1),
(2), (4) Date: Nov. 9, 2006

(87) PCT Pub. No.: WO2005/033610

PCT Pub. Date: Apr. 14, 2005

(65) Prior Publication Data

US 2007/0108242 A1 May 17, 2007

Related U.S. Application Data

(60) Provisional application No. 60/501,387, filed on Sep. 9, 2003.

(51) Int. Cl.
*F41C 33/02* (2006.01)

(52) U.S. Cl. ..... 224/243; 224/912; 42/70.11

(58) Field of Classification Search ..... 224/243, 224/193, 192, 245; 42/119, 114, 143, 136, 42/148, 70.11
See application file for complete search history.

(56) References Cited

U.S. PATENT DOCUMENTS

| | | | | |
|---|---|---|---|---|
| 3,550,822 | A | 12/1970 | Lloyd | |
| 3,910,469 | A * | 10/1975 | Baldocchi | 224/198 |
| 5,768,816 | A | 6/1998 | Rassias | |
| 6,149,042 | A | 11/2000 | Rassias | |
| 6,267,279 | B1 | 7/2001 | Matthews | |
| 6,415,541 | B1 | 7/2002 | Rassias | |

FOREIGN PATENT DOCUMENTS

| | | |
|---|---|---|
| WO | WO 01/51876 | 7/2001 |
| WO | WO 2004/071231 | 8/2004 |

* cited by examiner

*Primary Examiner*—Tri M Mai
(74) *Attorney, Agent, or Firm*—The Webb Law Firm

(57) ABSTRACT

Holster (10) is provided having shroud (20) with top (28), sides (34, 34'), slide bearing stop (22) with hole (24) facing slide guard. Cam slot (44) is provided through shroud (20). Protuberance slots (36, 36') are provided in shroud (20) for receiving pistol protuberance (99). Screw (84) pivotally secures lever (70) to shroud (20). Lever (70) includes lever arm (72) having actuator (74) with bearing (76) and cam arm (78) having guide cam (80) positioned in cam slot (44) into side of shroud (20). A method for using holster is provided.

15 Claims, 7 Drawing Sheets

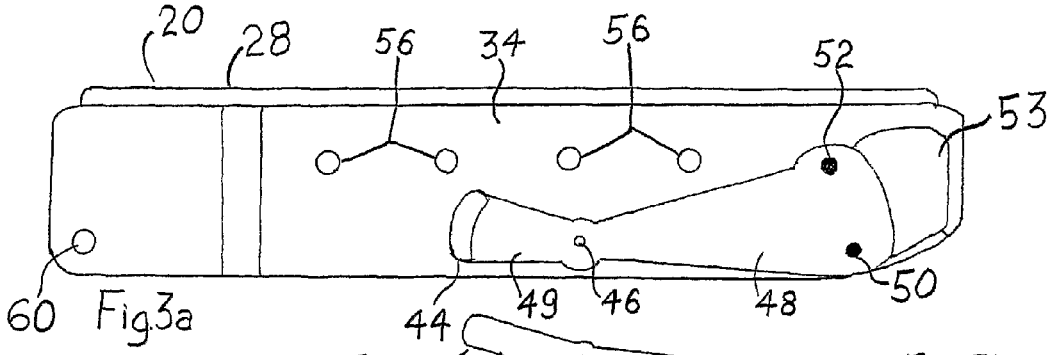
Fig.3a
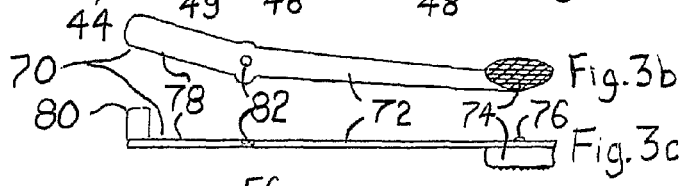
Fig.3b
Fig.3c
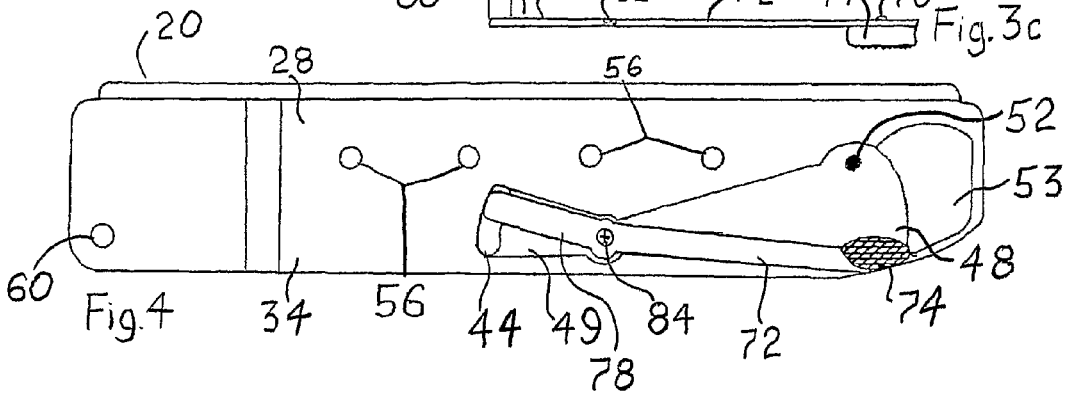
Fig.4

SECURITY HOLSTER WITH LOCKING LEVER

CROSS REFERENCE TO RELATED APPLICATIONS

This application claims the benefit of U.S. Provisional Application No. 60/501,387 entitled "Security Holster with Locking Lever," filed on Sep. 9, 2003, which is incorporated by reference.

BACKGROUND OF THE INVENTION

1. Field of the Invention

The present invention relates to a holster for a pistol. Specifically, the present invention relates to a holster that works synergistically with the mechanics of a pistol through the action of drawing and holstering the pistol, and having a lever to secure a pistol safely in the holster.

2. Description of Related Art

Throughout history, military leaders have consistently concluded that the most powerful weapon in an arsenal is the element of surprise, which contributes to the philosophy behind the present holster invention. Generally, all previous holsters have been designed as passive storage receptacles for a pistol with various snaps, straps and tensioning devices to secure a pistol in the holster. Customarily, a safer holster resulted through the addition of multiple layers of restriction of access to the pistol. Although valid for casual access to a pistol in a holster, the custom has, however, proven to be detrimental to the safety of the officer or anyone carrying a pistol in a holster who may require immediate access to defend himself or others from violent aggression.

The present invention is a dynamic holster which uses the mechanical functioning of the pistol to work synergistically in the holstering and drawing of a pistol, optionally loaded, with greater speed and safety than other holsters. The incorporation of the element of surprise is based primarily on reversing the drawing maneuver of a pistol from a holster from up to down movement. In prior art holsters, the drawing action requires pulling a pistol up and out of a holster, which telegraphs the drawing motion to an adversary. Through the action of drawing, the upper torso of an individual drawing a pistol from a holster moves to the side with the arm and shoulder lifting the pistol up and out of a holster, which requires approximately four to six inches of clearance of the pistol from the holster. Conversely, in the absence of any lateral movement of the upper torso, an individual can instantly draw a pistol, possibly loaded, from the present invention by pushing down on the grip less than an inch to compress the recoil spring of the pistol, which releases the pistol within one inch to target acquisition in under a second. Additionally, when holstered, a pistol is secured in the present invention by the partially compressed recoil spring of the pistol, which renders the pistol unfireable because the chamber is contained in a partially open condition, rendering the trigger automatically disconnected from the neutralized sear of the pistol, preventing release of the firing pin.

The drawing of a pistol from the present invention functions to action the pistol into a loaded status with a hot trigger with the accompanying audible sound of a slide of a pistol locking into an optional loaded condition. The sound of drawing a pistol from the present invention is highly recognizable and possesses an internationally understood language of its own. The audible effects of drawing a pistol from a holster alone are a disorienting and daunting surprise to any adversary facing a loaded weapon which seemingly appeared out of nowhere, not telegraphed by any movement of the drawer of the pistol. Alternatively, a pistol can also be drawn from the holster with very little sound in cases where stealth is required. Moreover, a pistol can be drawn from the holster in an unloaded state by simply partially or totally removing the magazine from the pistol before drawing the pistol from the holster.

The advantages of the present invention embrace multiple themes of safety. The present invention is two to four times faster in drawing and reholstering, accompanied with substantially higher levels of safety when compared with a conventional holster. The present invention provides a safe and secure means of carrying a holstered pistol, which is secure from a pistol grab attempt by a perpetrator. A pistol holstered in the present invention is incapable of discharge because the trigger is disengaged while the pistol is in the holster. The present invention also provides an excellent non-permanent storage capability, accompanied with the locking pin and lock feature, which secures a pistol in the holster, rendering it incapable of being discharged, removed or disassembled from the holster. The drawing of a pistol from the present invention can occur quickly, with or without sound, all of which is controlled by easy to master simple motor skills. Another safety benefit is actualized when a pistol is being drawn from the holster, because throughout the act of drawing, the muzzle of the pistol always points away from the drawer, which avoids the accidental shooting of oneself. Drawing loaded on-target timing tests were consistently less than ¾ second than with traditional holsters. Additionally, singlehanded reholstering can be accomplished to a safe locked position within the present invention within ½ second. Structurally, the present invention provides full protection for precisely calibrated front as well as rear pistol sights which are contained within open areas in the holster when a pistol is loaded. Another feature of the present invention is found in that a pistol having an add-on, such as a laser sight or light, is still capable of proper holstering in the present invention. The extremely durable material that comprises the present invention will not rust, rot or lose its form and function.

There is a present need for a holster with a locking lever comprising multiple features that significantly increases the safe carry and storage of a pistol, while also providing extremely fast drawing and reholstering, when needed.

SUMMARY OF THE INVENTION

The present invention provides a holster with a locking lever and methods of use thereof which, in combining unique features of the invention, significantly increases the safe carry and storage of a pistol, while also providing extremely fast drawing and reholstering when required.

A holster for securing a pistol is provided, which includes a shroud having a slide bearing stop with a barrel hole and access passage that is connected through a top and two sides to face an opposing slide guard. A cam slot is provided through one side of the shroud. Protuberance slots are provided in the sides of the shroud to receive a protuberance of a pistol. A lever is pivotally secured to the shroud, preferably by a screw, rivet or other securement means known in the art. An actuator is provided on the lever arm of the lever to move the lever from a first position, whereby a detent mechanism of the cam arm of the lever engages detents in the guide path of the side of the shroud. A guide cam is provided on the lever at the opposing end from the actuator. The guide cam is slidably positioned within the cam slot in the shroud. The guide cam is adapted to move from a first position to a second position within the slot, wherein in the first position the guide cam is positioned outside of the at least one protuberance slot, and wherein in the second position, the guide cam is positioned within the at least one protuberance slot to obstruct the protuberance on the pistol.

A method for holstering, drawing and storing a pistol with a protuberance in the holster is provided. Holstering a pistol in the holster occurs quickly through an all-in-one motion. The method includes the step of selectively positioning an obstruction, preferably a guide cam, in a first position outside of a protuberance slot of the holster. The method includes the step of placing the front of a slide of a pistol against the slide bearing stop and pushing the handle of the pistol toward the slide bearing stop so that the barrel of the pistol passes into the barrel hole provided in the slide bearing stop. Once this occurs, the method includes the further step of pivoting the pistol towards the top of the shroud, wherein the protuberance of the pistol is positioned within the protuberance slot of the shroud so that upon releasing the force on the handle of the pistol, the recoil spring of the pistol biases the handle towards the slide guard. The protuberance of the pistol is slidably positioned within the protuberance slot and is held there through bias action of the recoil spring. The method also includes the step of slidably positioning the obstruction into a second position within the protuberance slot in the shroud to maintain the protuberance of the pistol in a receiving space of the protuberance slot by blocking removal of the protuberance of the pistol from the receiving space.

Drawing a pistol from the holster can occur just as quickly as holstering by reversing the all-in-one motion of holstering the pistol. With the locking pin removed from the lock hole of the shroud, the method of drawing a pistol from the holster includes the steps of selectively positioning the obstruction in a first position outside the protuberance slot, pushing the handle of the pistol towards the slide-bearing stop wherein the barrel of the pistol enters into the barrel hole and the protuberance of the pistol is positioned adjacent to an opening of the protuberance slot; pivoting the pistol away from the top of the shroud whereby the protuberance of the pistol exits the protuberance slot; and then releasing the force exerted on the handle allowing the slide to engage the pistol and permitting the withdrawal of the pistol from the holster.

A pistol can be carried in the holster or, alternatively, can be stored in an unloaded state and even locked in the holster by inserting a locking pin through the lock hole of the shroud. When in a situation where drawing the pistol from the holster is necessary, a magazine can be loaded in the pistol so that when the pistol is drawn, the pistol will be automatically loaded with a cartridge. Alternatively, the pistol can be withdrawn from the holster with the magazine removed so that a cartridge is not loaded into the chamber.

BRIEF DESCRIPTION OF THE DRAWINGS

FIG. 3*a* illustrates a side view of a shroud in accordance with the present invention;

FIG. 3*b* illustrates a side view of a locking lever in accordance with the present invention;

FIG. 3*c* illustrates a top view of a locking lever as shown in FIG. 3*b;*

FIG. 4 illustrates a side view of a shroud with a locking lever pivotally mounted thereto in a first position in accordance with the present invention;

DESCRIPTION OF THE PREFERRED EMBODIMENT

Figures 1A, 1B:
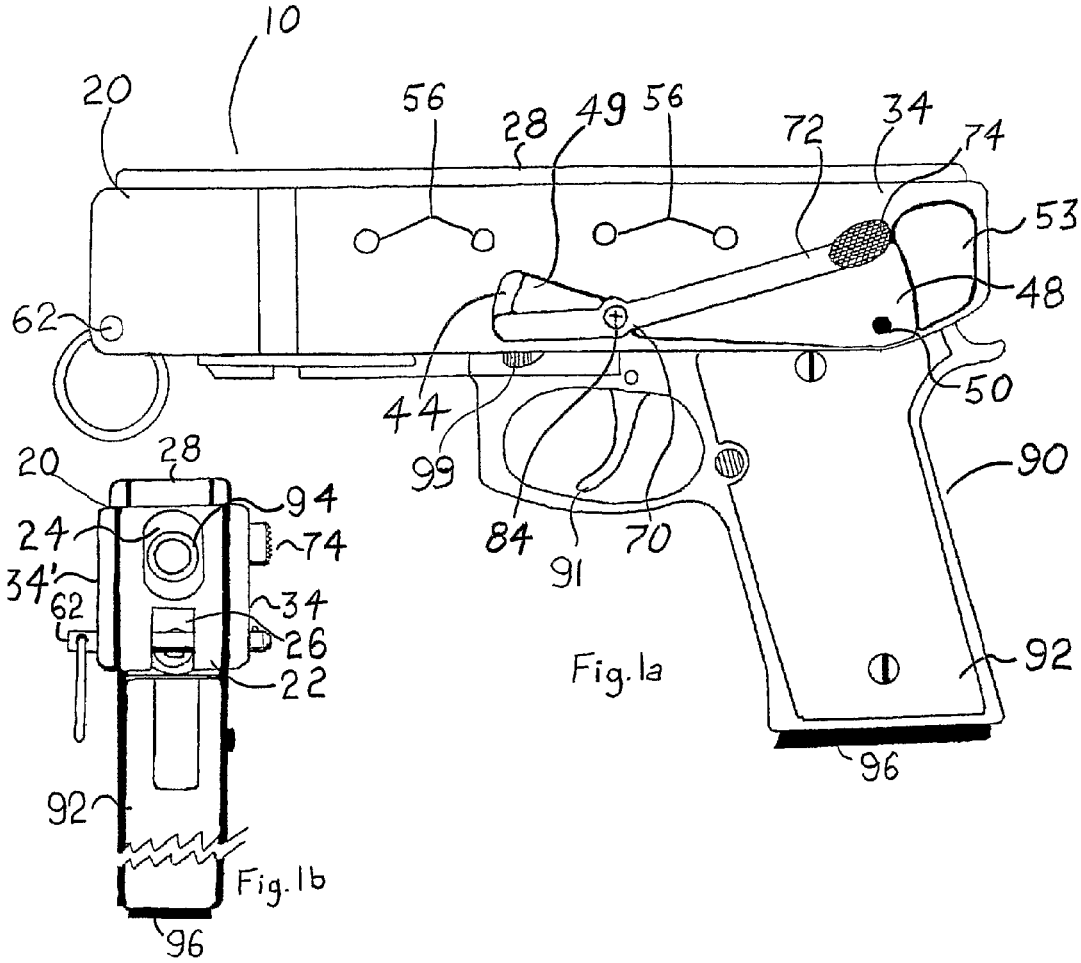
FIG. 1*a* illustrates a side view of a pistol holstered in a holster with a locking lever in a second position in accordance with the present invention.
FIG. 1*b* illustrates a front view of the holstered pistol as shown in FIG. 1*a;*

Referring to FIGS. 1 through 6 in which like reference characters refer to like parts throughout the several views thereof, holster 10 with a locking lever 70 for pistol 90 and method of use thereof is provided by the present invention. Holster 10 comprises generally locking lever 70 pivotally attached to shroud 20. Shroud 20 with locking lever 70 is adapted to interact synergistically with pistol 90 for safely holstering, storing and drawing of pistol 90 from holster 10. Pistol 90 can be any type of slide-action pistol.

Referring generally to all FIGS., shroud 20 is provided and comprises a rectangularly-shaped structure having one open side. Specifically, shroud 20 includes slide bearing stop 22 which is connected by top 28 and sides 34, 34' to slide guard 54. Slide bearing stop 22 is at the opposite end of shroud 20 from slide guard 54 such that slide bearing stop 22 faces slide guard 54. Shroud 20 is comprised of materials such as metal, high density plastics or any other material known in the art, which is highly durable and capable of withstanding rust, rot and fracture from a moderate force.

Referring to FIGS. 1*b,* 2, 5*a* and 5*b,* barrel hole 24 and access passage 26 are provided in slide bearing stop 22 of shroud 20. Barrel hole 24 of slide bearing stop 22 is adapted to temporarily receive barrel 94 of pistol 90 while holstering and drawing pistol 90 in relation to holster 10. Slide bearing stop 22 of shroud 20 also includes access passage 26 which provides a space for a guide rod of pistol 90 or other structure associated with handle 92 to enter while holstering or drawing pistol 90. As shown specifically in FIGS. 2 and 5*a,* the interior surface of top 28 of shroud 20 includes front sight groove 30 and rear sight groove 32, which are spaces in top 28 of shroud 20 that provide a space to receive and to protect a front sight and a rear sight of pistol 90.

Figure 2:
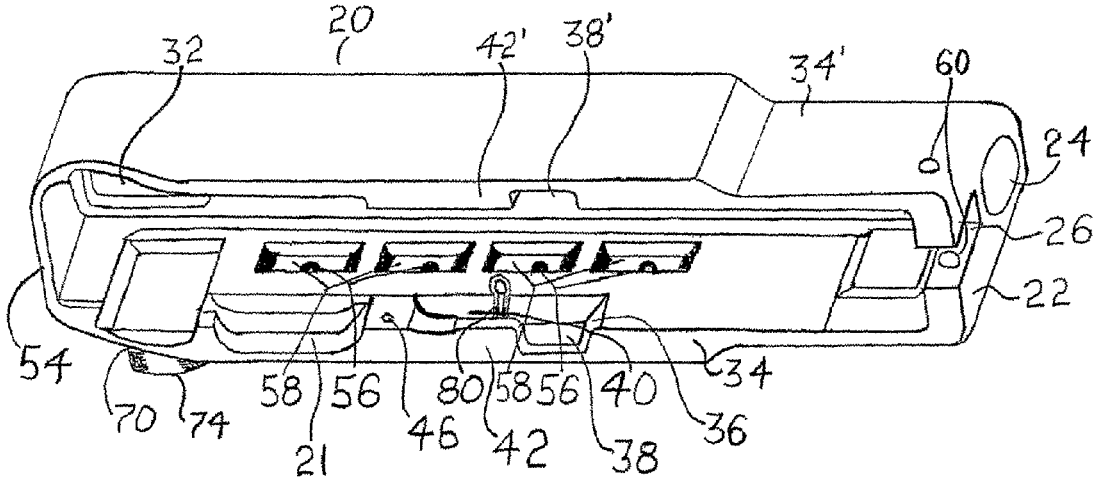
FIG. 2 illustrates a perspective view of the holster with a locking lever in a first position in accordance with the present invention.

Referring to FIG. 2, sides 34, 34' of shroud 20 are provided and include protuberance slots 36, 36'. Protuberance slots 36, 36' are comprised of openings 38, 38' on the bottom side of sides 34, 34', which are in communication with receiving spaces 40, 40' and which are confined in part by sides 34, 34' as well as platforms 42, 42' of shroud 20. Protuberance slots 36, 36' provide spaces to receive protuberance 99 of pistol 90. Protuberance 99 of pistol 90 is preferably a slide lock lever or similar device of pistol 90.

Figure 5A:
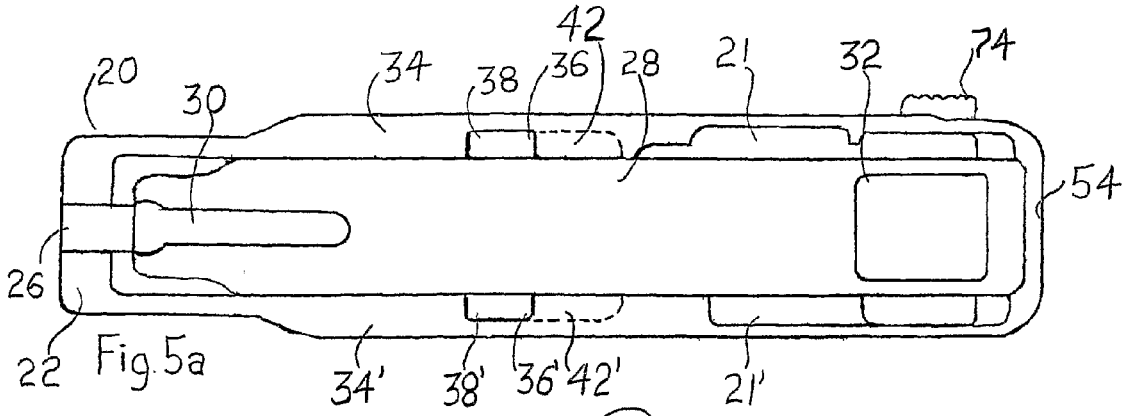
FIG. 5*a* illustrates a bottom view of the holster with a locking lever in accordance with the present invention.
Figure 5B:
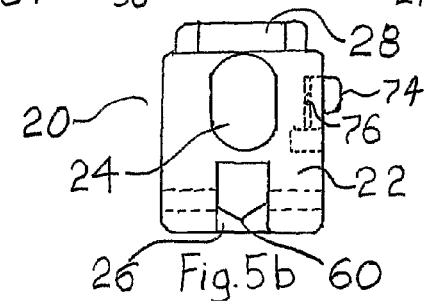
FIG. 5*b* illustrates a front view of the holster with a locking lever as shown in FIG. 5*a*.

Referring to FIGS. 2 and 5*a,* sides 34, 34' of shroud 20 are thicker in approximately the back two-thirds of sides 34, 34', meaning sides 34, 34' are thicker on the slide guard 54 end of shroud 20. The thickness of the material comprising sides 34, 34' provides a structure, which is modified to include cam slot 44, hole 46, a recessed cam arm guide path 49 and recessed lever arm guide path 48, which includes first detent 50 and second detent 52. The recessed lever action detent 53 is also provided adjacent to lever arm guide path 48. Cam slot 44, cam arm guide path 49, lever arm guide path 48 and lever action detent 53 are incorporated into the exterior surface of side 34 of shroud 20. Hole 46 transits entirely through side 34 of shroud 20. Cam slot 44 also transits entirely through side 34 of shroud 20. Mounting screw holes 56 are provided in side 34 of shroud 20. Mounting screw holes 56 transit through side 34 of shroud 20. On the interior surface of side 34, mounting screw detents 58 are provided to receive mounting screws within the interior surface of side 34.

Referring to FIGS. 2, 3*a,* 4 and 5*b,* locking pin holes 60 are provided through slide bearing stop 22 of shroud 20. Locking pin holes 60 transit through slide bearing stop 22, transversely across shroud 20. Locking pin holes 60 provide a receiving space for storage pin 62 to lock pistol 90 holstered in holster 10.

Referring to FIGS. 1*a,* 2, 3*a-c,* 4 and 6, locking lever 70 is provided, and comprises lever arm 72, which is offset from corresponding cam arm 78. Hole 82 is provided, which transits entirely through locking lever 70. An actuator 74 is mounted on the side surface of lever arm 72, which provides a friction surface to action lever arm 72. FIG. 3*c* shows a detent mechanism, which is essentially a half-round configuration. Preferably, the detent mechanism is a bearing 76 mounted within the interior surface of lever arm 72 on the side opposing actuator 74. Alternatively, the detent mechanism is any other half-round configuration known in the art, which is capable of engaging either first detent 50 or second detent 52. Bearing 76 protrudes beyond the interior surface of lever arm 72. As shown specifically in FIGS. 2 and 3*c,* guide cam 80 is provided at the end of cam arm 78. Guide cam 80 is an elongated, three-dimensional structure. Screw 84 is used to pivotally attach locking lever 70 to shroud 20, whereby screw 84 is inserted through hole 82 of locking lever 70, which corresponds with hole 46 of side 34 of shroud 20. Alternatively, other pivotal mounting means could be incorporated to mount locking lever 70 to shroud 20, such mounting means includes a rivet or similar device as known in the art. When locking lever 70 is pivotally mounted on shroud 20, lever arm 72 is positioned within the lever arm guide path 48 recessed in side 34 of shroud 20. As mounted, bearing 76 of locking lever 70 can be positioned in either first detent 50 or second detent 52 within lever arm guide path 48 recessed into side 34 of shroud 20. Additionally, cam arm 78, having guide cam 80 attached thereto, engages cam arm guide path 49 which is recessed into side 34 of shroud 20. Guide cam 80 is slidably positioned within cam slot 44 of shroud 20, which is in communication with side 34 and protuberance slot 36 of shroud 20.

Figure 6:
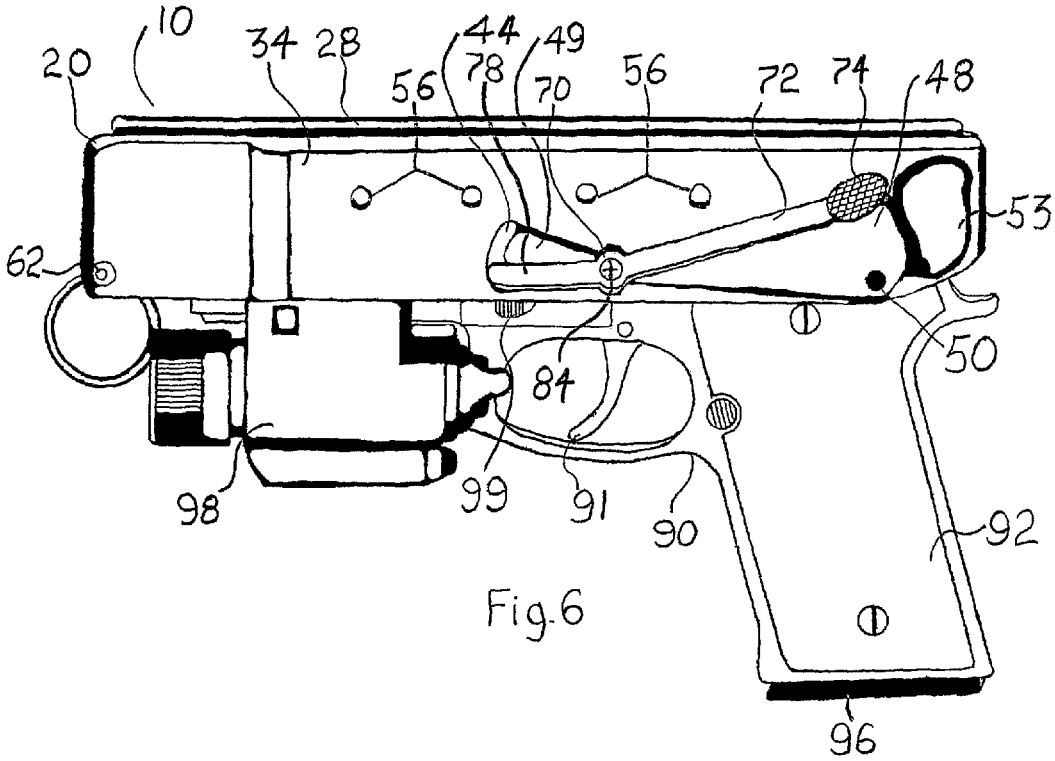
FIG. 6 illustrates a perspective view of a pistol having an illumination device attached thereto, holstered in the holster with locking safety pin engaged with a locking lever in a second position in accordance with the present invention.

Locking lever 70 is capable of moving between and engaging with a detent mechanism, a first position as shown in FIG. 4 and a second position as shown in FIGS. 1*a* and 6. The length of lever arm 72 provides enough flexibility within locking lever 70 to allow bearing 76 of lever arm 72 to engage either first detent 50 or second detent 52, as well as slide across a prescribed surface within lever arm guide path 48 of shroud 20.

In the first position, bearing 76 of locking lever 70 engages first detent 50 within lever arm guide path 48 of shroud 20. When locking lever 70 is in the first position, which is the open position, cam arm 78, which is offset from lever arm 72, positions guide cam 80 in the upper portion of cam slot 44. When locking lever 70 is in the first position, protuberance slot 36 is not obstructed by guide cam 80, so that a protuberance 99 of pistol 90 is free to move within protuberance slot 36 such that pistol 90 can be holstered as well as drawn from holster 10.

Locking lever 70 can also be placed in the second position, which is the closed position. In the second position, bearing 76 of lever arm 72 of locking lever 70 is placed in second detent 52 within lever arm guide path 48 of shroud 20. When locking lever 70 is in the second position, cam arm 78 positions guide cam 80 in cam slot 44 within receiving space 40 of protuberance slot 36 of shroud 20. In the second position, receiving space 40 of protuberance slot 36 is obstructed with the presence of guide cam 80, such that protuberance 99 of pistol 90, which is positioned within receiving space 40 of protuberance slot 36, is blocked from removal from protuberance slot 36. Thereby, pistol 90 is holstered and temporarily locked by locking lever 70 within holster 10.

Pistol 90 holstered within holster 10 can be further secured in holster 10 by inserting storage pin 62 through locking pin holes 60 within slide bearing stop 22 of shroud 20 as shown in FIGS. 1*a* and *b*. Storage pin 62 may also be locked with a lock. With storage pin 62 inserted into locking pin holes 60, regardless of whether locking lever 70 is in a first position, pistol 90 cannot be moved forward because storage pin 62 blocks the forward movement of the guide arm of pistol 90 or related structure, thereby securing pistol 90 in an unfireable state within holster 10.

Further aspects of the invention are provided in detail in relation to the method of using holster 10 for holstering, drawing and storing pistol 90 in relation to holster 10.

A method for using holster 10 with pistol 90 is provided with the present invention. The method includes steps for holstering pistol 90 in holster 10 and even locking holstered pistol 90 within holster 10 and also drawing pistol 90 from holster 10. The holstering and drawing of pistol 90 in association with holster 10 occurs through an all-in-one motion.

Holstering pistol 90 in holster 10 requires first selectively positioning locking lever 70 in a first position, whereby guide cam 80 affixed to cam arm 78 of locking lever 70 is positioned within cam slot 44 of shroud 20 such that guide cam 80 does not obstruct protuberance slot 36 of side 34 of shroud 20. While in the first position, bearing 76 mounted within lever arm 72 of locking lever 70 engages first detent 50 provided within lever arm guide path 48 of shroud 20. While locking lever 70 is in the first position, the method includes placing the front of a slide of pistol 90 against the interior surface of slide bearing stop 22, and then pushing handle 92 of pistol 90 toward slide bearing stop 22, whereby barrel 94 of pistol 90 is inserted into barrel hole 24 of slide bearing stop 22. The guide rod and potentially another structure of handle 92 of pistol 90 is also positioned within access passage 26 of slide bearing stop 22 of shroud 20. Handle 92 of pistol 90 is pushed far enough toward slide bearing stop 22 so that protuberance 99, preferably a slide stop lever of pistol 90, is capable of passing through opening 38 and entering into protuberance slot 36 within side 34 of shroud 20. This occurs by pivoting pistol 90 about slide bearing stop 22 towards top 28 of shroud 20.

Figure 7:
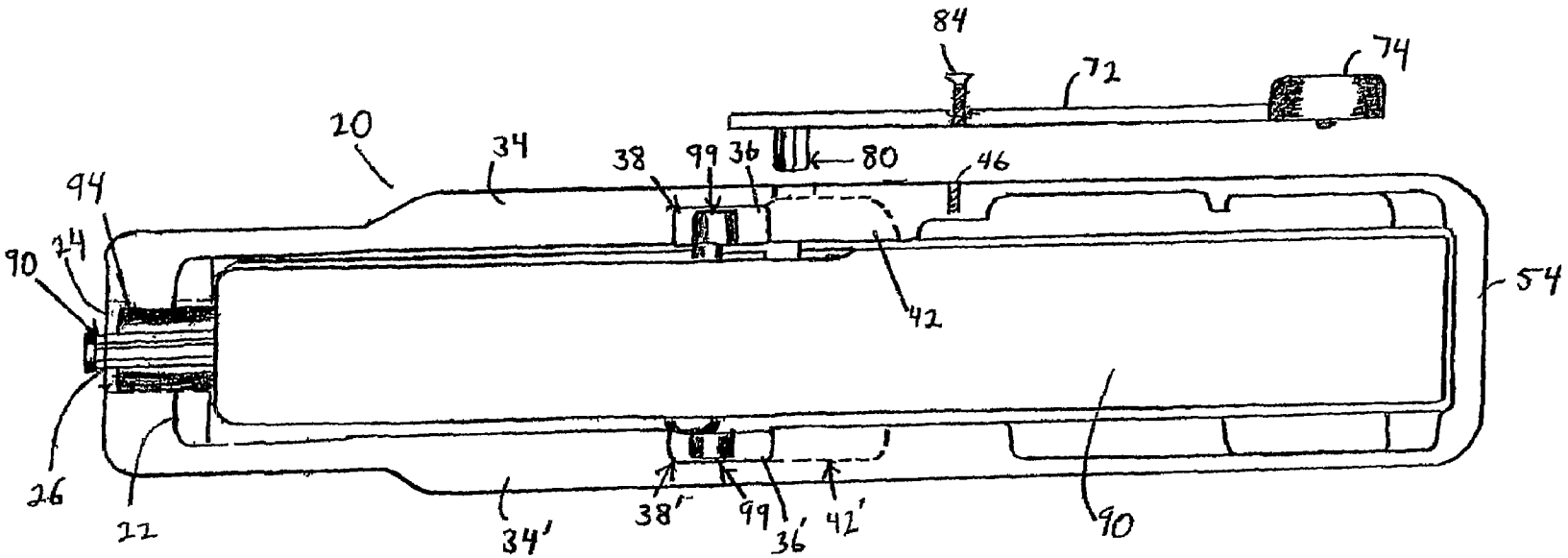
FIG. 7 illustrates a bottom view of a pistol being holstered in a holster in accordance with the present invention with the protuberance of the pistol entering an opening formed in the bottom side of a side of the shroud. A locking lever is shown detached from the holster.
Figure 8:
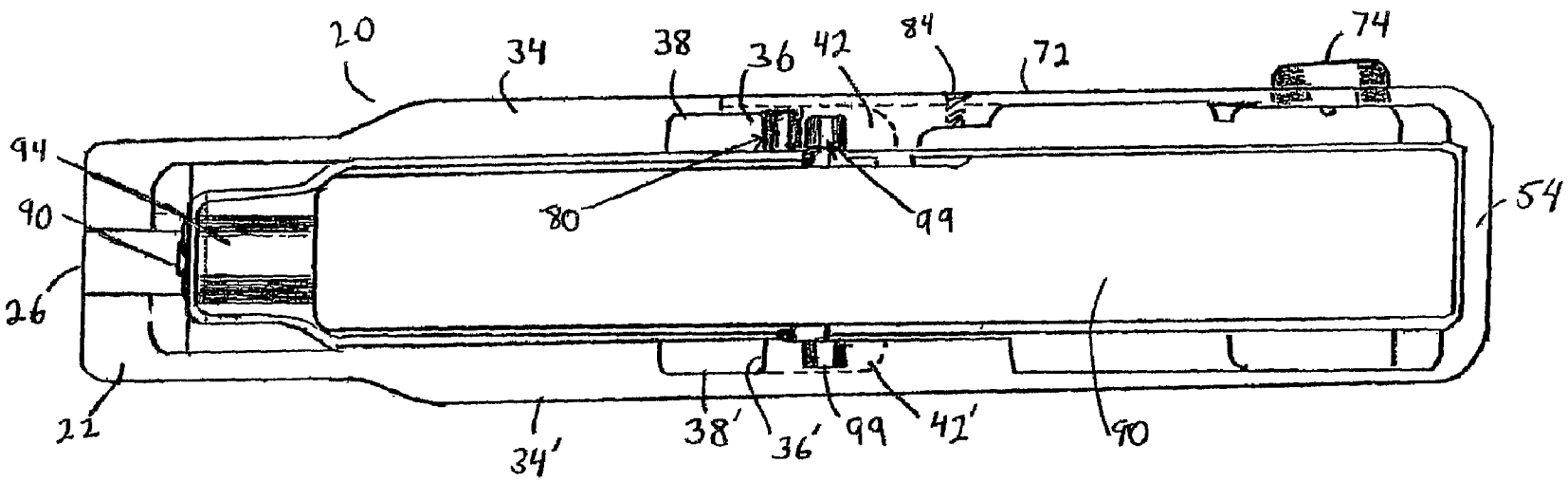
FIG. 8 illustrates a bottom view of a pistol being holstered in a holster in accordance with the present invention with the protuberance of the pistol positioned in the receiving space of the protuberance slot and the locking lever pivotally mounted thereto in a second position.

The steps of holstering the pistol 90 can be further understood by referring to FIGS. 7 and 8. FIG. 7 shows the position of various parts of the pistol 90 relative to the holster 20 when handle 92 of pistol 90 has been pushed toward slide bearing stop 22. In particular, barrel 94 of pistol 90 is inserted into barrel hole 24 of slide bearing stop 22 and guide rod 90 of pistol is positioned within access passage 26 of slide bearing stop 22. Handle 92 of pistol 90 is pushed far enough toward slide bearing stop 22 so that protuberance 99 is capable of passing through opening 38 disposed on the bottom side of side 34 of shroud 20 and into protuberance slot 36 when pistol 90 is pivoted about slide bearing stop 22 in a direction toward the closed top of shroud 20.

Once the protuberance 99 of pistol 90 is positioned within protuberance slot 36, the method includes releasing force exerted on handle 92 of pistol 90 in a controlled fashion, thereby allowing the recoil spring of pistol 90 to bias handle 92 toward slide guard 54 of shroud 20, whereby the protuberance 99 of pistol 90 slidably engages receiving space 40 of protuberance slot 36. After the force is released from handle 92 of pistol 90, the method includes selectively positioning an obstruction, preferably guide cam 80, in a second position within protuberance slot 36 to obstruct removal of protuberance 99 of the pistol 90 from receiving space 40 of protuberance slot 36. FIG. 8 shows the effect of releasing the force exerted on handle 92 of pistol 90. Release of the force exerted on handle 92 causes protuberance 99 to move within protuberance slot 36 toward slide guard 54 of shroud 20 and into receiving space 40, shown in FIG. 2, of protuberance slot 36. Once protuberance 99 is positioned within receiving space 40 of protuberance slot 36, an obstruction, such as guide cam 80, can be positioned within protuberance slot 36 to obstruct removal of protuberance 99 from receiving space 40 of protuberance slot 36 and back through opening 38 disposed on the bottom side of side 34 of shroud 20.

The movement of locking lever 70 from the first position to the second position occurs by pivoting locking lever 70 about the pivotal attachment point through screw 84 so that lever arm 72 is moved through force exerted against actuator 74 of lever arm 72 and bearing 76 is removed from first detent 50 of lever arm guide path 48 to second detent 52 of lever arm guide path 48, whereby bearing 76 engages second detent 52. Lever action detent 53 provides a friction point for the thumb of an operator to move selectively locking lever 70. In moving locking lever 70 from the first position to the second position, locking lever 70 pivots about the pivot point so that cam arm 78 moves guide cam 80 through cam slot 44 of shroud 20 into a second position such that guide cam 80 is positioned within receiving space 40 of protuberance slot 36, which hinders the protuberance 99 of pistol 90 from being removed from protuberance slot 36. At this point, pistol 90 is holstered and secured by locking lever 70 within holster 10.

Pistol 90 can be carried within holster 10 mounted to an attachment assembly such as that provided in WO 2004/071231, entitled "Adjustable Stabilizing Belt Attachment Assembly" or any other attachment assembly which is capable of mounting a holster to a belt or any other structure used to carry a pistol in a holster. Shroud 20 can be connected to the adjustable stabilizing belt attachment assembly by way of mounting screws which engage mounting screw holes 56 of shroud 20, whereby the mounting screws are recessed into mounting screw detents 58 so as not to impede the action of holstering and drawing pistol 90 from holster 10.

As an added level of safety, pistol 90, which is holstered in holster 10 and locked in place by locking lever 70 in the second position, can be further secured in holster 10 by inserting storage pin 62 through locking pin holes 60 of slide bearing stop 22 of shroud 20. Storage pin 62 can also be locked so that it cannot be easily removed from slide bearing stop 22. The insertion of storage pin 62 into locking pin holes 60 of slide bearing stop 22 within shroud 20 prevents the removal of pistol 90 from holster 10 based on the blockage of access passage 26 of slide bearing stop 22 by storage pin 62. Storage pin 62 blocks the entry of the guide rod and other handle 92 component of pistol 90 into access passage 26, thereby preventing handle 92 of pistol 90 from being moved toward slide bearing stop 22. With storage pin 62 positioned within locking pin holes 60, pistol 90 will remain holstered within holster 10 whether locking lever 70 is placed in either the first or second positions. Storage pin 62 provides additional safety storage means for pistol 90 within holster 10.

The principal safety feature of the present invention results the moment that pistol 90 is pushed into shroud 20 as the slide of pistol 90 is restrained from forward or rearward movement while handle 92 of pistol 90 is still capable of forward or backward movement in relation to the slide. As handle 92 of pistol 90 is moved forward in relation to a slide, the trigger bar is disengaged, rendering pistol 90 incapable of discharge. Pistol 90 remains in this unfireable state as long as pistol 90 is holstered within holster 10 and until it is withdrawn from holster 10, with or without a loaded magazine 96. The unfireable state results from pistol 90 being in a condition in holster 10 such that the slide is partially open, thereby automatically disengaging the trigger bar. In this state, notwithstanding the fact that the trigger bar is disengaged, the hammer of pistol 90, which is a slide action pistol having an external hammer, is also restricted from reaching a cocked position by slide guard 54, which would be required in order for pistol 90 to fire.

Pistol 90 holstered in holster 10 can be drawn from holster 10 in a manner that reverses the steps of holstering pistol 90 through an all-in-one motion. The steps of drawing pistol 90 occurs after selectively positioning locking lever 70 in the first position, if not already there, and with the storage pin 62 removed from locking pin holes 60. The next step involves pushing handle 92 of pistol 90 toward slide bearing stop 22, which has barrel 94 of pistol 90 passing into barrel hole 24 of slide bearing stop 22. Additionally, as handle 92 of pistol 90 is pushed toward slide bearing stop 22, the protuberance 99 of pistol 90 moves within protuberance slot 36 into opening 38 so that the protuberance 99 of pistol 90 can clear protuberance slot 36 of side 34 of shroud 20. Once in this position, the next step of drawing pistol 90 includes pivoting pistol 90 about slide bearing stop 22 away from top 28 of shroud 20, whereby the protuberance 99 of pistol 90 exits opening 38 of side 34 of shroud 20. The final step of drawing pistol 90 from holster 10 involves releasing the downward force on handle 92 of pistol 90, thereby allowing handle 92 of pistol 90 to move away from slide bearing stop 22, thereby locking the slide of pistol 90, which results in engaging the trigger 91 of pistol 90, with the hammer in a cocked position.

The drawing of pistol 90 from holster 10 can result in either a loaded or unloaded pistol 90. For pistol 90 to be in a loaded state after being drawn from holster 10, a loaded magazine 96 must be inserted into pistol 90 before drawing pistol 90 so that in the step of drawing pistol 90 from holster 10, a cartridge will be loaded from magazine 96 into the battery of pistol 90. As handle 92 engages the slide of the pistol 90, the trigger 91 is active, the hammer is cocked and a cartridge is loaded in the chamber, thereby resulting in pistol 90 being capable of discharge. Alternatively, the magazine can be removed from pistol 90 so that when pistol 90 is drawn from holster 10, a cartridge is not loaded from the magazine 96 into the battery of pistol 90, even though the trigger 91 will be activated as handle 92 engages the slide of pistol 90 and the trigger 91 will be cocked.

Although the present invention has been described with reference to the preferred embodiment, this disclosure is illustrative and exemplary of the present invention, and is made merely for purposes of providing a full disclosure of the invention. Other embodiments of the invention can achieve the same result. Accordingly, other embodiments, adaptations, variations, modifications and equivalent arrangements will be apparent to those skilled in the art.

I claim:

1. A holster for securing a pistol having a protuberance, the holster comprising:

a shroud having a slide bearing stop with a barrel hole and an access passage, the slide bearing stop connected by a top and two sides to face an opposing slide guard;

a cam slot in a side of the shroud;

at least one protuberance slot in at least one side of the shroud comprising an opening on a bottom side of the side of the shroud; and a lever pivotally secured to the shroud, the lever having a lever arm with an actuator having a detent mechanism therein and a cam arm having a guide cam extending into the cam slot of the shroud; wherein the guide cam is slidably positioned in the slot and adapted to move from a first position to a second position within the slot, wherein in the first position the guide cam is positioned outside of the at least one protuberance slot, and wherein in the second position, the guide cam is positioned within the at least one protuberance slot to obstruct the protuberance on the pistol.

2. The holster of claim 1, wherein the lever is pivotally secured to the shroud by a screw that passes through a first hole of the lever corresponding with a second hole of the shroud.

3. The holster of claim 1, wherein the shroud has a guide path to control movement of the lever from a first position to a second position.

4. The holster of claim 3, wherein the detent mechanism is a half-round configuration and the guide path has a first detent to engage the half-round configuration of the lever when the lever is in the first position and a second detent to engage the half-round configuration of the lever when the lever is in the second position.

5. The holster of claim 1, wherein the cam slot receives the guide cam of the lever, the cam slot having an arc-shape adapted to slidably engage the guide cam of the lever allowing the guide cam to move from a first position to a second position.

6. The holster of claim 1, wherein the shroud has holes to receive a storage locking pin.

7. The holster of claim 1, wherein the top of the shroud has a front aperture adapted to receive a front sight of a pistol and a rear aperture adapted to receive a rear sight of a pistol.

8. The holster of claim 1, wherein the side of the shroud having the cam slot has mounting holes for use in mounting the holster.

9. The holster of claim 1, wherein the at least one protuberance slot further comprises a receiving space defined by the side and platform of the shroud.

10. A method for using a holster with a pistol having a protuberance, the method comprising the steps of:

selectively positioning an obstruction in a first position outside of a protuberance slot of the holster;

placing a front of a slide of a pistol against an interior face of a slide bearing stop of the shroud;

pushing a handle of the pistol toward the slide bearing stop whereby a barrel of the pistol passes into a barrel hole of the slide bearing stop;

pivoting the pistol about the slide bearing stop toward a top of the shroud, wherein the protuberance of the pistol is positioned within the protuberance slot of the shroud;

releasing force on the handle allowing a recoil spring of the pistol to bias the handle toward a slide guard of the holster, wherein the protuberance of the pistol is slidably positioned in a receiving space adjacent the protuberance slot; and selectively positioning the obstruction in a second position within the protuberance slot to maintain the protuberance of the pistol within the receiving space.

11. The method according to claim 10, wherein the step of selectively positioning the obstruction in a first position includes engaging a detent mechanism with a first detent of the shroud.

12. The method according to claim 10, wherein the step of selectively positioning the obstruction in a second position includes the step of engaging a detent mechanism with a second detent of the shroud.

13. The method of holstering a pistol in a holster in claim 10, further comprising the step of locking the holster by placing a locking pin in holes of the shroud.

14. The method of claim 10, comprising the further steps of:

selectively positioning the obstruction in the first position outside of the protuberance slot;

pushing the handle of the pistol toward the slide bearing stop wherein the barrel of the pistol passes into the barrel hole of the slide bearing stop and wherein the protuberance of the pistol is positioned adjacent to an opening within the protuberance slot of the shroud;

pivoting the pistol about the slide bearing stop away from the top of the shroud, wherein the protuberance of the pistol exits the protuberance slot; and releasing force on the handle allowing the slide to engage the pistol, and permitting withdrawal of the pistol from the holster.

15. A holster for a pistol having a protuberance comprising a shroud having a top, two sides, a slide bearing stop with a barrel hole facing an opposing slide guard, a cam slot is provided through one of the two sides of the shroud, at least one protuberance slot is provided in a side of the shroud adapted to receive the protuberance of the pistol and comprising an opening on a bottom side of the side of the shroud, and a lever is pivotally secured to the side of the shroud with the slot therein, the lever having a lever arm with an actuator and a detent mechanism and having a cam arm with a guide cam, the guide cam is slidably positioned within the cam slot of the shroud, the lever is selectively moveable between a first position wherein the guide cam is removed from the protuberance slot and the holster can receive a pistol, and a second position wherein the guide cam is positioned within the protuberance slot and the guide cam restrains the protuberance of the pistol within the holster.

* * * * *

UNITED STATES PATENT AND TRADEMARK OFFICE

CERTIFICATE OF CORRECTION

PATENT NO. : 7,850,053 B2
APPLICATION NO. : 11/596093
DATED : December 14, 2010
INVENTOR(S) : Rassias It is certified that error appears in the above-identified patent and that said Letters Patent is hereby corrected as shown below:

Title Page, See Item (56) References Cited, U.S. PATENT DOCUMENTS, insert the following:

-- 6, 112,962 09/2000 Matthews --

Signed and Sealed this
Twenty-sixth Day of April, 2011

David J. Kappos

David J. Kappos
*Director of the United States Patent and Trademark Office*